US011056010B2

(12) United States Patent
Bailey

(10) Patent No.: US 11,056,010 B2
(45) Date of Patent: Jul. 6, 2021

(54) VERIFYING FLIGHT INFORMATION

(71) Applicant: The Boeing Company, Chicago, IL (US)

(72) Inventor: Louis J. Bailey, Covington, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 16/450,643

(22) Filed: Jun. 24, 2019

(65) Prior Publication Data

US 2020/0402411 A1 Dec. 24, 2020

(51) Int. Cl.
*G08B 21/00* (2006.01)
*G08G 5/00* (2006.01)

(52) U.S. Cl.
CPC ..... *G08G 5/0017* (2013.01); *G08G 5/0004* (2013.01)

(58) Field of Classification Search
CPC .. G08G 5/0017; G08G 5/0004; G08G 5/0047; G08G 5/0082; G08G 5/0021; H04B 7/18506; H04L 63/123; G06F 40/279
USPC ..... 340/971
See application file for complete search history.

(56) References Cited

U.S. PATENT DOCUMENTS 8,630,790 B1 * 1/2014 Bailey ..... G08G 5/0013 701/120
9,530,323 B1 * 12/2016 Maji ..... G01S 13/06
2005/0216281 A1 * 9/2005 Prior ..... G06Q 10/02 705/5
2013/0085669 A1 4/2013 Bailey et al.
2014/0106333 A1 * 4/2014 Dugan ..... G07C 5/0825 434/428
2016/0063416 A1 * 3/2016 Sharma ..... G06F 40/174 705/7.23
2017/0039858 A1 2/2017 Wang et al.
2017/0054740 A1 * 2/2017 Mitchell ..... H04L 51/18
2017/0236425 A1 * 8/2017 Ballestros ..... G08G 5/0008 342/32

FOREIGN PATENT DOCUMENTS

EP 3101820 12/2016

OTHER PUBLICATIONS

Extended European Search Report for European Patent Application No. 20171497.9 dated Oct. 7, 2020.

* cited by examiner

*Primary Examiner* — Mark S Rushing
(74) *Attorney, Agent, or Firm* — Kunzler Bean & Adamson

(57) ABSTRACT

Disclosed herein is a method. The method comprises retrieving a first message comprising flight information that is input into a flight information system associated with a flight. The method also comprises receiving a second message comprising flight information that is input into the flight information system associated with the flight based on the first message. The method further comprises verifying that the flight information that is sent in the first message matches the flight information that is received in the second message. The method additionally comprises providing a notification in response to verifying that the flight information that is sent in the first message does not match the flight information that is received in the second message.

20 Claims, 6 Drawing Sheets

VERIFYING FLIGHT INFORMATION

FIELD

This disclosure relates generally to aircraft, and more particularly to verifying flight information for the aircraft during the aircraft's flight.

BACKGROUND

Aircraft may be equipped with a computer system or a system of computers that controls portions of the aircraft's flight. During flight, various data may be provided to the computer system to maintain or adjust the aircraft's flight.

SUMMARY

The subject matter of the present application has been developed in response to the present state of the art. Accordingly, the subject matter of the present application has been developed to verify flight information for a flight.

Disclosed herein is a method. The method comprises retrieving a first message comprising flight information that is input into a flight information system associated with a flight. The method also comprises receiving a second message comprising flight information that is input into the flight information system associated with the flight based on the first message. The method further comprises verifying that the flight information that is sent in the first message matches the flight information that is received in the second message. The method additionally comprises providing a notification in response to verifying that the flight information that is sent in the first message does not match the flight information that is received in the second message. The preceding subject matter of this paragraph characterizes example 1 of the present disclosure.

The flight information that is sent in the first message matches the flight information that is received in the second message in response to determining that the flight information that is received in the second message is within a threshold of the flight information that is sent in the first message. The preceding subject matter of this paragraph characterizes example 2 of the present disclosure, wherein example 2 also includes the subject matter according to example 1, above.

The first message and the second message comprise different format types such that the first message and the second message are parsed to identify the flight information in each message for verification. The preceding subject matter of this paragraph characterizes example 3 of the present disclosure, wherein example 3 also includes the subject matter according to any one of examples 1-2, above.

Verification comprises comparing the flight information of the first message and the second message based on the formats of the first message and the second message to determine if the flight information of the first message and the second message match. The preceding subject matter of this paragraph characterizes example 4 of the present disclosure, wherein example 4 also includes the subject matter according to example 3, above.

The comparison of the flight information between the first message and the second message is performed on one or more of a per-bit basis, a per-byte basis, a per-character basis, a per-data-field basis, and a per-message basis. The preceding subject matter of this paragraph characterizes example 5 of the present disclosure, wherein example 5 also includes the subject matter according to example 4, above.

The flight information that is sent in the first message is inputted into the flight information system in response to one of when the first message is received and when a user approves inputting the flight information. The preceding subject matter of this paragraph characterizes example 6 of the present disclosure, wherein example 6 also includes the subject matter according to any one of examples 1-5, above.

The method further comprises detecting an input event in response to the flight information in the first message being input into the flight information system. The first message is retrieved, and the flight information is received in the second message, in response to the input event. The preceding subject matter of this paragraph characterizes example 7 of the present disclosure, wherein example 7 also includes the subject matter according to example 6, above.

A type and delivery method of the notification that is provided is determined based on a significance of the flight information that is input into the flight information system and that does not match the flight information sent in the first message. The preceding subject matter of this paragraph characterizes example 8 of the present disclosure, wherein example 8 also includes the subject matter according to any one of examples 1-7, above.

The notification is provided as one or more of a push notification for a mobile application, a text message, an email message, a website, and a web service. The preceding subject matter of this paragraph characterizes example 9 of the present disclosure, wherein example 9 also includes the subject matter according to any one of examples 1-8, above.

One of the first message and the second message comprises an aircraft communications addressing and reporting system ("ACARS") message format. The preceding subject matter of this paragraph characterizes example 10 of the present disclosure, wherein example 10 also includes the subject matter according to any one of examples 1-9, above.

The second message is published and broadcast to systems that subscribed to receive messages that comprise flight information that is input into the flight information system. The preceding subject matter of this paragraph characterizes example 11 of the present disclosure, wherein example 11 also includes the subject matter according to any one of examples 1-10, above.

The second message is received from the flight information system in response to a query for the flight information. The preceding subject matter of this paragraph characterizes example 12 of the present disclosure, wherein example 12 also includes the subject matter according to any one of examples 1-11, above.

Further disclosed herein is an apparatus. The apparatus comprises a processor. The apparatus also discloses a memory that stores code executable by the processor to retrieve a first message comprising flight information that is input into a flight information system associated with a flight, receive a second message comprising flight information that is input into the flight information system associated with the flight based on the first message, verify that the flight information that is sent in the first message matches the flight information that is received in the second message, and provide a notification in response to verifying that the flight information that is sent in the first message does not match the flight information that is received in the second message. The preceding subject matter of this paragraph characterizes example 13 of the present disclosure.

The flight information that is sent in the first message matches the flight information that is received in the second message in response to determining that the flight information that is received in the second message is within a threshold of the flight information that is sent in the first message. The preceding subject matter of this paragraph characterizes example 14 of the present disclosure, wherein example 14 also includes the subject matter according to example 13, above.

The first message and the second message comprise different format types such that the first message and the second message are parsed to identify the flight information in each message for verification. The preceding subject matter of this paragraph characterizes example 15 of the present disclosure, wherein example 15 also includes the subject matter according to any one of examples 13-14, above.

The code is further executable by the processor to verify the flight information in each message by comparing the flight information of the first message and the second message based on the formats of the first message and the second message to determine if the flight information of the first message and the second message match. The preceding subject matter of this paragraph characterizes example 16 of the present disclosure, wherein example 16 also includes the subject matter according to example 15, above.

The comparison of the flight information between the first message and the second message is performed on one or more of a per-bit basis, a per-byte basis, a per-character basis, a per-data-field basis, and a per-message basis. The preceding subject matter of this paragraph characterizes example 17 of the present disclosure, wherein example 17 also includes the subject matter according to example 16, above.

The code is further executable by the processor to detect an input event in response to the flight information in the first message being input into the flight information system. The first message is retrieved, and the flight information is received in the second message, in response to the input event, the flight information that is sent in the first message being input into the flight information system in response to one of when the first message is received and when a user approves inputting the flight information. The preceding subject matter of this paragraph characterizes example 18 of the present disclosure, wherein example 18 also includes the subject matter according to any one of examples 13-17, above.

A type and delivery method of the notification that is provided is determined based on a significance of the flight information that is input into the flight information system and that does not match the flight information sent in the first message. The preceding subject matter of this paragraph characterizes example 19 of the present disclosure, wherein example 19 also includes the subject matter according to any one of examples 13-18, above.

Additionally disclosed herein is a program product comprising a computer readable storage medium that stores code executable by a processor, the executable code comprising code to retrieve a first message comprising flight information that is input into a flight information system associated with a flight, receive a second message comprising flight information that is input into the flight information system associated with the flight based on the first message, verify that the flight information that is sent in the first message matches the flight information that is received in the second message, and provide a notification in response to verifying that the flight information that is sent in the first message does not match the flight information that is received in the second message. The preceding subject matter of this paragraph characterizes example 20 of the present disclosure.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter and are not therefore to be considered to be limiting of its scope, the subject matter will be described and explained with additional specificity and detail through the use of the drawings, in which.

DETAILED DESCRIPTION

Reference throughout this specification to "one embodiment," "an embodiment," or similar language means that a particular feature, structure, or characteristic described in connection with the embodiment is included in at least one embodiment of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

Figure 1:
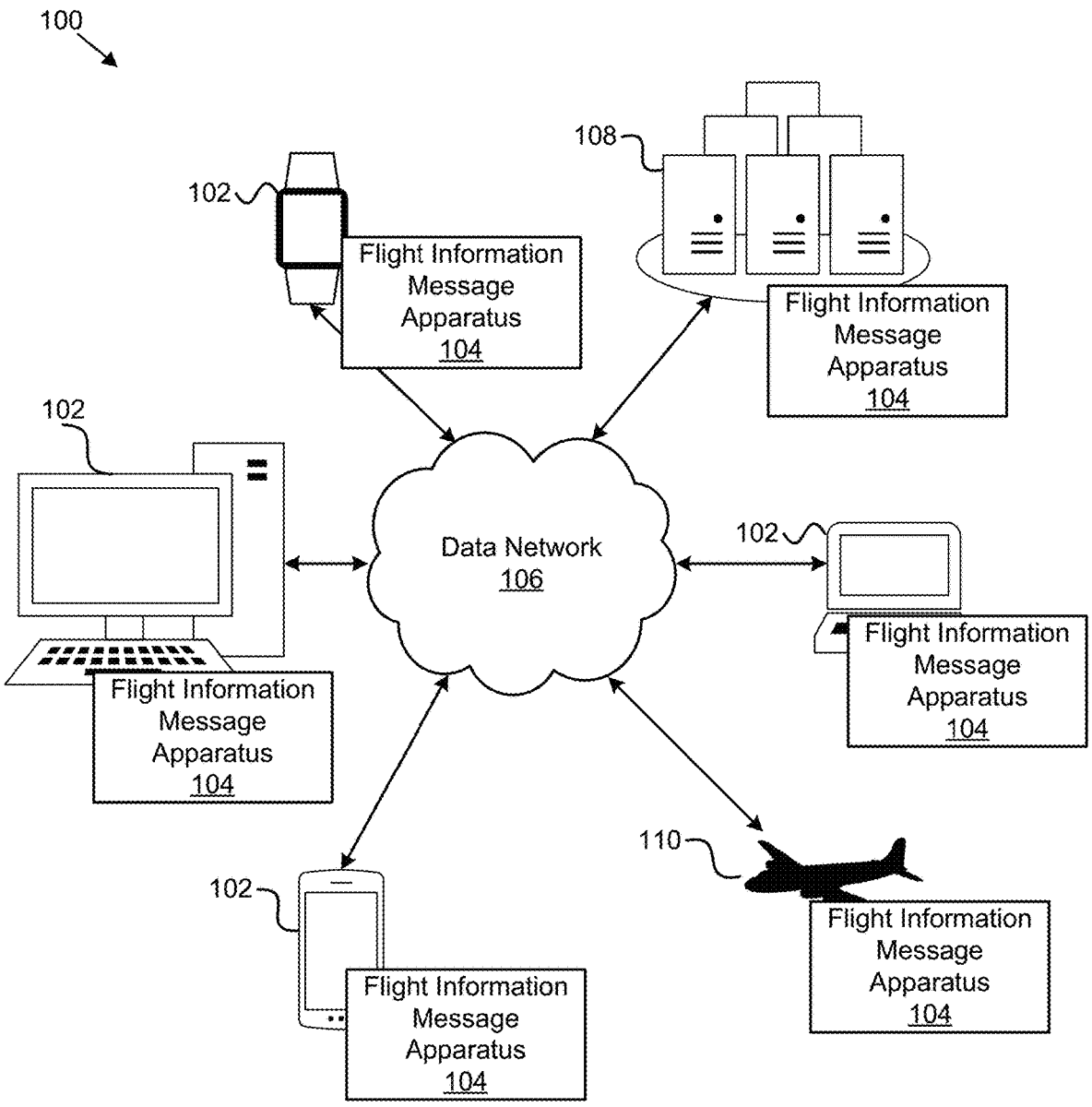
FIG. 1 is a schematic block diagram of a system for verifying flight information, according to one or more examples of the present disclosure.

FIG. 1 is a schematic block diagram illustrating one embodiment of a system 100 for verifying flight information. The system 100 includes one or more information handling devices 102, one or more message apparatuses 104, one or more data networks 106, one or more servers 108, and one or more aircraft 110. Even though a specific number of information handling devices 102, message apparatuses 104, data networks 106, one or more servers 108, and aircraft 110 are depicted in FIG. 1, one of skill in the art will recognize, in light of this disclosure, that any number of information handling devices 102, message apparatuses 104, data networks 106, servers 108, and aircraft 110 may be included in the system 100.

The information handling devices 102 of the system 100 may include one or more of a desktop computer, a laptop computer, a tablet computer, a smart phone, a smart speaker (e.g., Amazon Echo®, Google Home®, Apple HomePod®), a security system, a set-top box, a gaming console, a smart TV, a smart watch, a fitness band or other wearable activity tracking device, an optical head-mounted display (e.g., a virtual reality headset, smart glasses, or the like), a High-Definition Multimedia Interface ("HDMI") or other electronic display dongle, a personal digital assistant, a digital camera, a video camera, or another computing device comprising a processor (e.g., a central processing unit ("CPU"), a processor core, a field programmable gate array ("FPGA") or other programmable logic, an application specific integrated circuit ("ASIC"), a controller, a microcontroller, and/or another semiconductor integrated circuit device), a volatile memory, and/or a non-volatile storage medium.

In certain embodiments, the information handling devices 102 are communicatively coupled to one or more other information handling devices 102 and may be located on the aircraft 110, one or more servers 108, and/or one or more aircraft 110 over the data network 106, described below. The information handling devices 102 may include processors, processor cores, and/or the like that are configured to execute various programs, program code, systems, applications, instructions, functions, and/or the like for sending and receiving messages, comparing information, storing and querying data in databases, and/or the like.

In one embodiment, the flight information message apparatus 104 is configured to retrieve a first message sent to flight information system such as a flight management system for an aircraft 110. The first message may include flight information that is input into a flight information system. In further embodiments, the flight information message apparatus 104 receives flight information that is input into the flight information system associated with the flight based on the first message. The flight information from the flight information system may be received in a second message. The flight information message apparatus 104, in certain embodiments, verifies that the flight information that is sent in the first message matches the flight information that is received in the second message, and provides a notification in response to verifying or determining that the flight information in the first and second messages does not match. In this manner, the flight information message apparatus 104 can verify that flight information, including important flight information, is being received and correctly entered into the flight information system and provide timely alerts or notifications to other interested, subscribed, or registered systems via data network 106 if it is not.

In various embodiments, the flight information message apparatus 104 is located on an aircraft 110 as part of a flight information system or other computing system associated with the aircraft 110, is located on a ground-based computing system, and/or some combination of both. The flight information message apparatus 104, in some embodiments, is embodied as a hardware appliance that can be installed or deployed on an information handling device 102, on a server 108, on an aircraft 110, and/or elsewhere on the data network 106. In certain examples, the flight information message apparatus 104 includes a hardware device such as a secure hardware dongle or other hardware appliance device (e.g., a set-top box, a network appliance, or the like) that attaches to a device, a laptop computer, a server 108, a tablet computer, a smart phone, a security system, or the like, either by a wired connection (e.g., a universal serial bus ("USB") connection) or a wireless connection (e.g., Bluetooth®, Wi-Fi, near-field communication ("NFC"), or the like); that attaches to an electronic display device (e.g., a television or monitor using an HDMI port, a DisplayPort port, a Mini DisplayPort port, VGA port, DVI port, or the like); and/or the like. A hardware appliance of the flight information message apparatus 104 includes a power interface, a wired and/or wireless network interface, a graphical interface that attaches to a display, and/or a semiconductor integrated circuit device as described below, configured to perform the functions described herein with regard to the flight information message apparatus 104.

The flight information message apparatus 104 includes a semiconductor integrated circuit device (e.g., one or more chips, die, or other discrete logic hardware), or the like, such as a field-programmable gate array ("FPGA") or other programmable logic, firmware for an FPGA or other programmable logic, microcode for execution on a microcontroller, an application-specific integrated circuit ("ASIC"), a processor, a processor core, or the like, in some examples. In one embodiment, the message apparatus 104 is mounted on a printed circuit board with one or more electrical lines or connections (e.g., to volatile memory, a non-volatile storage medium, a network interface, a peripheral device, a graphical/display interface, or the like). The hardware appliance includes one or more pins, pads, or other electrical connections configured to send and receive data (e.g., in communication with one or more electrical lines of a printed circuit board or the like), and one or more hardware circuits and/or other electrical circuits configured to perform various functions of the flight information message apparatus 104 in some examples.

The semiconductor integrated circuit device or other hardware appliance of the flight information message apparatus 104, in certain embodiments, includes and/or is communicatively coupled to one or more volatile memory media, which may include but is not limited to random access memory ("RAM"), dynamic RAM ("DRAM"), cache, or the like. In one embodiment, the semiconductor integrated circuit device or other hardware appliance of the flight information message apparatus 104 includes and/or is communicatively coupled to one or more non-volatile memory media, which may include but is not limited to: NAND flash memory, NOR flash memory, nano random access memory (nano RAM or NRAM), nanocrystal wire-based memory, silicon-oxide based sub-10 nanometer process memory, graphene memory, Silicon-Oxide-Nitride-Oxide-Silicon ("SONOS"), resistive RAM ("RRAM"), programmable metallization cell ("PMC"), conductive-bridging RAM ("CBRAM"), magneto-resistive RAM ("MRAM"), dynamic RAM ("DRAM"), phase change RAM ("PRAM" or "PCM"), magnetic storage media (e.g., hard disk, tape), optical storage media, or the like.

In another embodiment, the flight information message apparatus 104 may consist of software services and software applications. Flight information message apparatuses, systems, modules, and/or the like may execute in memory on another device and communicate with the illustrated computing systems, flight information systems, aircraft 110, or other information handling devices 102 via inter-computer communications hosted for processing flight messages containing flight information and individual flight information parameters.

The data network 106, in one embodiment, includes a digital communication network that transmits digital communications. The data network 106 includes a wireless network, such as a wireless cellular network, a local wireless network, such as a Wi-Fi network, a Bluetooth® network, a near-field communication ("NEC") network, an ad hoc network, and/or the like, in certain examples. The data network 106 includes a wide area network ("WAN"), a storage area network ("SAN"), a local area network (LAN), an optical fiber network, the internet, or other digital communication network, in certain examples. In some examples, the data network 106 includes two or more networks. In one example, the data network 106 includes one or more servers, routers, switches, and/or other networking equipment. In some examples, the data network 106 includes one or more computer readable storage media, such as a hard disk drive, an optical drive, non-volatile memory, RAM, or the like.

The wireless connection is a mobile telephone network in one example. The wireless connection employs a Wi-Fi network based on any one of the Institute of Electrical and Electronics Engineers ("IEEE") 802.11 standards in one example. Alternatively, the wireless connection is a Bluetooth® connection in certain examples. In addition, the wireless connection employs a Radio Frequency Identification ("RFID") communication including RFID standards established by the International Organization for Standardization ("ISO"), the International Electrotechnical Commission ("IEC"), the American Society for Testing and Materials® (ASTM®), the DASH7™ Alliance, and EPCGlobal™ in various examples.

Alternatively, the wireless connection may employ a ZigBee® connection based on the IEEE 802 standard. In one embodiment, the wireless connection employs a Z-Wave® connection as designed by Sigma Designs®. Alternatively, the wireless connection may employ an ANT® and/or ANT+® connection as defined by Dynastream® Innovations Inc. of Cochrane, Canada.

The wireless connection may be an infrared connection including connections conforming at least to the Infrared Physical Layer Specification ("IrPHY") as defined by the Infrared Data Association® ("IrDA"®). Alternatively, the wireless connection may be a cellular telephone network communication. All standards and/or connection types include the latest version and revision of the standard and/or connection type as of the filing date of this application.

The one or more servers 108, in one embodiment, are embodied as blade servers, mainframe servers, tower servers, rack servers, and/or the like. The one or more servers 108 are configured as mail servers, web servers, application servers, FTP servers, media servers, data servers, web servers, file servers, virtual servers, and/or the like in some examples. The one or more servers 108 are communicatively coupled (e.g., networked) over a data network 106 to one or more information handling devices 102 in certain examples. The one or more servers 108 stores data in data structures such as databases, data repositories, or the like in some examples.

Figure 2:
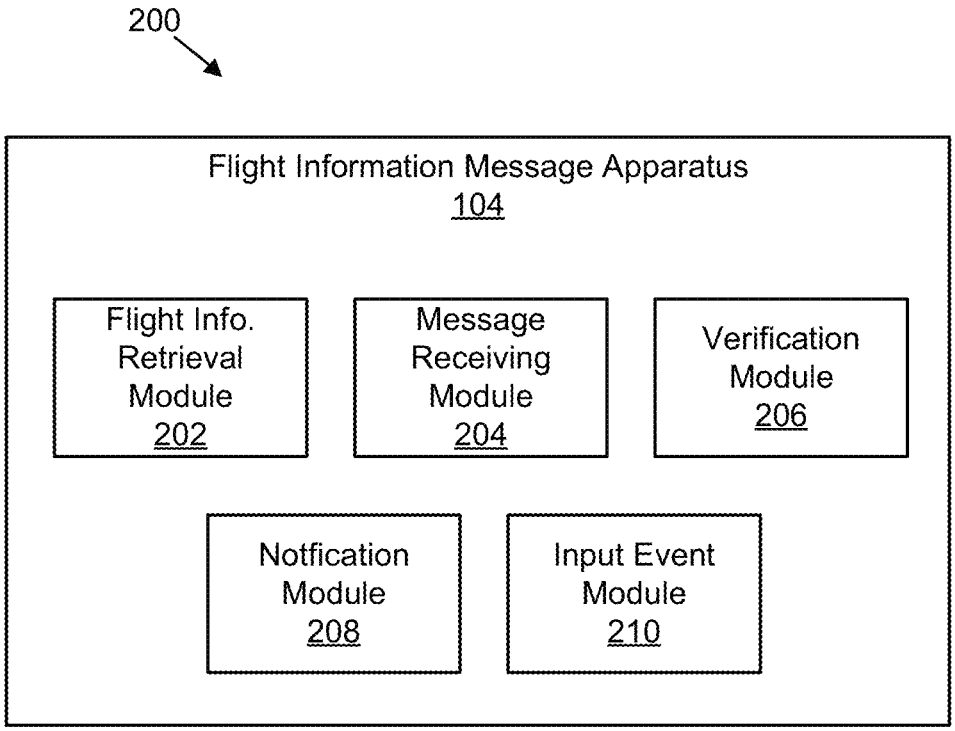
FIG. 2 is a schematic block diagram of an apparatus for verifying flight information, according to one or more examples of the present disclosure.

FIG. 2 depicts one embodiment of an apparatus 200 for verifying flight information. The apparatus 200 includes an embodiment of the message apparatus 104. The message apparatus 104, in certain implementations, includes one or more of a flight information retrieval module 202, a message receiving module 204, a verification module 206, a notification module 208, and an input event module 210, which are described in more detail below.

The flight information retrieval module 202, in one embodiment, is configured to retrieve a message that has been, or is being sent to an aircraft 110, such as a commercial airplane, a helicopter, and/or the like, or other flight information system that is associated with an aircraft 110. In one embodiment, the message is sent from a ground-based message system, a ground-based computing system, a ground-based communication system, and/or the like that is communicatively coupled to the aircraft 110 over a data network 106 such as a cellular data network, a satellite data network, an airband radio transmission network, and/or the like. An example of such a network is the aircraft communications addressing and reporting system ("ACARS"), which is a digital datalink system for transmission of short messages between aircraft 110 and ground stations via airband radio or satellite.

Thus, the message is an electronic message such as a text message, an email message, a short message service ("SMS") message, an ACARS message, and/or another type of electronic message. The electronic message may have a known, predefined, predetermined, or otherwise recognizable format. For example, the flight information that is sent in the message may be located in predefined fields within the message (e.g., there may be a message header field, a message size/length field, a message parity field, and the message payload field, which may be divided into different predefined fields that include codes or other information that the flight management system can partition, read, and implement).

The message, in certain embodiments, includes flight information that is input into a flight information system such as a flight management system of an aircraft 110. As used herein, a flight management system is a specialized computer system that automates a wide variety of in-flight tasks, such as the flight plan. In other embodiments, the message is sent to various flight information systems such as airline flight planning systems, air traffic processor systems, air traffic control trajectory prediction systems, communication management unit systems, and/or the like. One of skill in the art will recognize, in light of this disclosure, the various information systems that may be associated with flight management for an aircraft 110.

The flight information may include status information that is tracked from the ground-based computer and/or messaging service such as an amount of fuel remaining, a weight of the aircraft 110, a wind speed, an air pressure reading, the speed of the aircraft 110, and/or the like, which the flight information system can use to maintain or adjust flight settings for the aircraft 110, e.g., via a flight management system. Other flight information may include information such as commands or actions, for example, commands to reduce or increase the aircraft's speed, commands to increase or reduce the aircraft's altitude, and/or the like.

The flight information retrieval module 202, in one embodiment, retrieves the sent message from a storage location at a ground-based computing system (e.g., the message that include flight information that is sent to the aircraft 110). In certain embodiments, the flight information retrieval module 202 retrieves the sent message from a storage location on an aircraft 110 (e.g., the message that includes flight information that the aircraft 110 receives).

The message receiving module 204, in one embodiment, is configured to receive a message comprising flight information that is input into the flight information system based on the first message. The flight information that is received in the second message may be received in a different message, which may have the same or different format as the message that included the flight information that was sent to the flight information system, e.g., the message sent to the flight management system of an aircraft 110 may be a sent over a satellite network and the message that is received from the aircraft 110 may be received over an airband radio network.

The message receiving module 204 may query a database, a log file, a system, and/or the like for flight information that has been entered into the flight information system, e.g., the flight management system for the aircraft 110. The message receiving module 204 may check for flight information in response to new flight information being received, entered, or input into the flight information system. For example, a pilot may review the flight information received from a ground-based message service and confirm the flight information before entry into the flight management system and the message receiving module 204 may receive a notification, event, signal, trigger, or the like that indicates new information has been received and entered into the flight management system. In certain embodiments, flight information may be altered, modified, changed, adjusted, or the like by the pilot, other crew member, a user, or by a different system prior to being input into the flight information system.

The message receiving module 204 may query the flight information system for the information that was received and/or entered in the flight information system. In certain embodiments, the message receiving module 204 sends the flight information in a message to the ground-based message service for further comparison or analysis, as explained below with reference to the verification module 206. In some embodiments, the message receiving module 204 sends the queried flight information in a message to a verification module 206 that is part of or in communication with the flight information system for further analysis of the queried flight information (e.g., whether it matches the flight information that was received at the aircraft 110 and/or entered by the pilot/crew member), with the results (e.g., the resultant comparison of whether the flight information that is received/entered matches the flight information that the flight management system is using) being sent to the ground-based message service. In some embodiments, the flight information is automatically entered into the flight information system in response to a user such as an air traffic controller, the pilot, or other crew member, reviewing and confirming entering the information into the flight information system, which avoids errors that can arise with the information being manually entered into the flight information system.

In certain embodiments, the message receiving module 204 associates the queried flight information with the message that was received at the flight information system so that the flight information that is received or inputted into the flight information system is mapped to the message that triggered the flight information being inputted into the flight information system. For instance, the message that contains the queried flight information may also include an identifier for the corresponding message that is received at the aircraft 110 such as a unique message identifier, a timestamp of when the message received at the aircraft 110 was sent or received, and/or the like.

In one embodiment, flight information may be streamed to and/or from a flight information system associated with a flight of an aircraft, such as aircraft 110. In such an embodiment, the flight information retrieval module 202 and the message receiving module 204 are combined, communicatively linked, operatively connected, or the like into a flight information socket (e.g., a network socket) in which flight information is received and queried through a subscription, registration, or the like to send and receive communications over the socket.

For instance, a flight information system may be embodied as a publisher in a publisher/subscriber-based system where the message receiving module 204, other systems, and/or other devices are embodied or configured as subscription systems for messages that comprise flight information that are sent from the flight information system. The flight information system may "publish" a message, e.g., send a message that contains flight information from the flight information system that is then broadcast, streamed, or otherwise transmitted to "subscriber" or registered systems such as the message receiving module 204. In this manner, the message receiving module 204 can receive messages that include flight information in real-time or with minimal delay between when the message is sent and when the message receiving module 204 receives it so that an accurate verification of the flight information that is being used in the flight information system can be performed.

The verification module 206, in one embodiment, is configured to verify that the flight information in the message that is sent to the flight information system associated with the flight matches the flight information in the message that is received from the flight information system associated with the flight, which may include flight information that is received at the aircraft 110, flight information that is entered into the flight information system (e.g., the flight management system of an aircraft 110), flight information that is queried or received from the flight information system, and/or the like. In other words, the verification module 206 can verify that the flight information is correctly received, entered, sent, or the like. If the verification module 206 determines that the flight information between the messages matches, then the flight information that was sent to the flight information system associated with the flight was correctly entered into the flight information system; otherwise, an error occurred with the data that was input into the flight information system.

In certain embodiments, the verification module 206 verifies that the flight information in the message that is sent to the flight information system associated with the flight and the flight information that is queried or received from the flight information system associated with the flight (e.g., the flight information that is entered in the flight management system) and sent in a different message from the flight information system matches by comparing the flight information on a per-message basis, a per-data-field basis, a per-word basis, a per-byte basis, a per-bit basis, a per-character basis, and/or the like.

For example, if the message that is sent to the flight information system associated with the flight and the message that is received from the flight information system associated with the flight are of the same type, e.g., an ACARS message, then the verification module 206 may perform a message-to-message compare, or may compare corresponding fields within the messages that include the flight information data, and/or the like. If the messages are of a different type, however, the verification module 206 may need to locate the flight information in the messages so that the flight information can be compared. For instance, the verification module 206 may locate the flight information based on the predefined format of the message (e.g., an ACARS message may store flight information in a predefined field, location, or position within the message). However, if the message does not have a predefined format, the verification module 206 may locate the flight information in the message using text, character, or string processing such as artificial intelligence based on situational context, natural language processing, regular expressions, and/or the like to locate the flight information, the fields where the flight information is located, and/or the like.

In one embodiment, the verification module 206 determines that the flight information that is received in the message from the flight information system associated with the flight (e.g., the flight information that is queried from the flight management system) matches the flight information that is sent in the message to the flight information system associated with the flight in response to determining that the flight information for both messages is within or satisfies a threshold value, amount, range, or the like. For instance, the ground-based message system may send a message with flight information providing the planned, forecasted, or estimated weight of the aircraft 110 (e.g., 70 tons) and the message received from the flight information system associated with the flight may include a weight value that was actually entered or inputted into the flight management system.

If the verification module 206 determines that the weight values in the messages are not the same, e.g., that the weight value sent to the flight information system associated with the flight does not match the weight value that was received at the flight information system associated with the flight or entered into the flight management system of the aircraft 110, then the verification module 206 may determine whether the weight values are within a predetermined threshold (e.g., ±100 pounds). If so, then the verification module 206 may determine that the flight information is a match and that the flight information that was sent to the flight information system associated with the flight was correctly inputted into the flight information system. Otherwise, the verification module 206 determines that there is a mismatch and incorrect flight information was entered into the flight information system. Other examples of flight information that may be important to verify includes performance initialization data, takeoff reference data, and/or the like.

In one embodiment, the notification module 208 is configured to provide a notification in response to the verification module 206 verifying that the flight information that is sent in the message to the flight information system associated with the flight does not match the flight information that is received in the message from the flight information system associated with the flight. The notification, for instance, may include a push notification for a mobile application, a text message, an email message, a website posting, a web service, and/or the like.

In certain embodiments, the type and delivery method of notification that the notification module 208 provides depends on the significance, importance, and/or the like of the flight information. For instance, if the flight information is more important and the verification module 206 determines that the flight information was not input correctly based on the comparison of the messages that are sent to and received from the flight information system associated with the flight, then the notification module 208 may trigger an alert, an alarm, a push notification, or the like that is intended to get a user's attention, e.g., a ground-crew member, a flight traffic controller, or the like by triggering sounds, lights, obstructing the user's display with a message, triggering an emergency call or alert, and/or the like. Otherwise, if the flight information is less important, then the notification module 208 may send a less-obvious or less-distracting notification to the user.

In one embodiment, the input event module 210 is configured to detect an input event in response to the flight information in the message that is received at the flight information system associated with the flight being input into the flight management system. As described above, the flight information that is received at the flight information system associated with the flight may be input into the flight management system manually by an air traffic controller, a pilot, or other crew member, may be reviewed by an air traffic controller, a pilot, or other crew member and confirmed for automatic input into the flight information system, or may be automatically input into the flight information system without review. The type of feedback that is necessary to input the flight information into the flight information system may depend on the significance, importance, or the like of the flight information, which may be indicated with a flag or other indicator in the message that is received at the flight information system associated with the flight.

In one embodiment, the flight information system or aircraft 110 may emit a signal, an alert, a notification, an event, and/or the like in response to flight information being input into the flight information system. In response to the event, the input event module 210 triggers the flight information retrieval module 202 to retrieve the message that was sent to the aircraft 110, the message receiving module 204 to query or receive the flight information that was input into the flight information system in response to receiving the message at the flight information system associated with the flight with the flight information, and the verification module 206 to verify that the flight information that was received at the flight information system associated with the flight matches the flight information that was input into the flight information system. Alternatively, or in addition to, in one embodiment, the input event module 210 is configured to listen to, subscribe to, and/or register to receive and/or queue incoming and/or outgoing messages as they are sent and received, which can be used to verify the flight information.

Figure 3A:
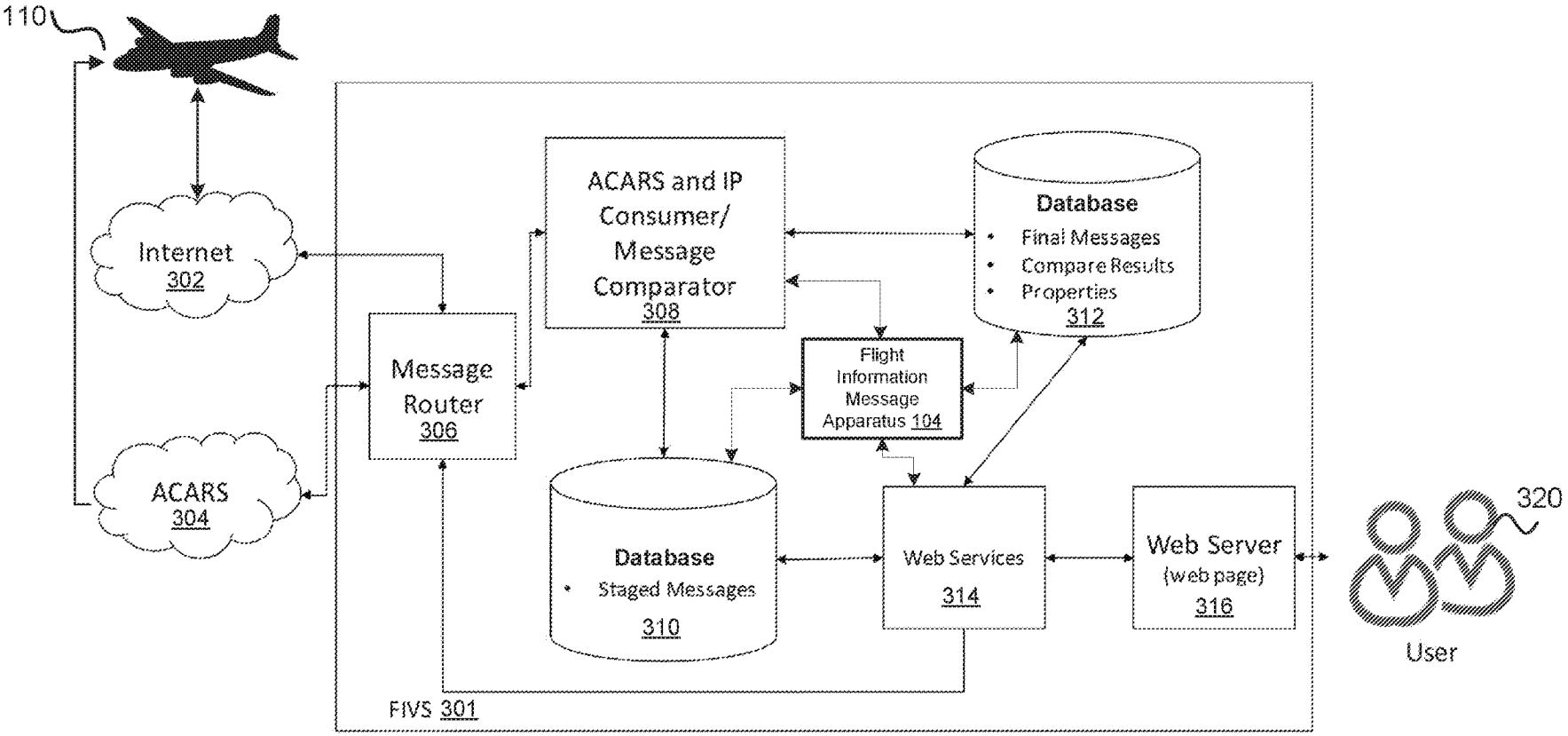
FIG. 3A illustrates one example embodiment of systems for verifying flight information, according to one or more examples of the present disclosure.

FIG. 3A depicts one embodiment of a flight information verification system ("FIVS") 301. In one embodiment, the FIVS 301 is a ground-based message computing system that is connected to an aircraft 110 via a network such as the Internet (e.g., an Internet protocol network) 302, an ACARS (e.g., satellite or radio airband) network 304, and/or the like. A message router 306 (which may be embodied as or used by the flight information retrieval module 202 and/or the message receiving module 204) may be configured to send messages from the FIVS 301 to an aircraft 110 and/or receive messages at the FIVS 301 from an aircraft 110 over the network 302, 304. The message router 306 may be embodied as a stand-alone device (e.g., a message server) or a hardware and/or software module.

In one embodiment, the message router 306 may store messages that have been sent, or are queued to be sent, to the aircraft 110 in a database 310 along with an identifier that uniquely identifies the messages. The message router 306 may also store messages received from the aircraft 110 that contain flight information from the flight management system of the aircraft 110 in the database 310, along with an identifier for the received message and also an identifier for the corresponding message that was sent to the aircraft 110. The verification module 206, in one embodiment, may use or trigger the message comparator 308 (e.g., an IP message or ACARS message comparator) to compare the flight information portions of the message sent to the aircraft 110 and the message received from the aircraft 110 to determine if the flight information matches. The message comparator 308 may store the compared messages, the comparison results, and/or other properties of the messages (e.g., the types of messages, the percent that was a match, whether the flight information was exactly the same or was within a predefined threshold, the importance or significance of the flight information, and/or the like) in an active or temporary data store, such as a database 312.

The notification module 208 may check the comparison results to determine whether to send a notification about the flight information not matching. In the depicted embodiment, the notification module 208 may provide a message or other information to a web service 314 for presentation to a user 320 on a web page that is served-up by a web server 316. The notification may include whether the information was a match or not, the threshold that was used to determine a match, the significance or importance of the information, the times that the messages were sent, the status (e.g., altitude, speed, etc.) of the aircraft 110 when the messages were sent, and/or the like.

Figure 3B:
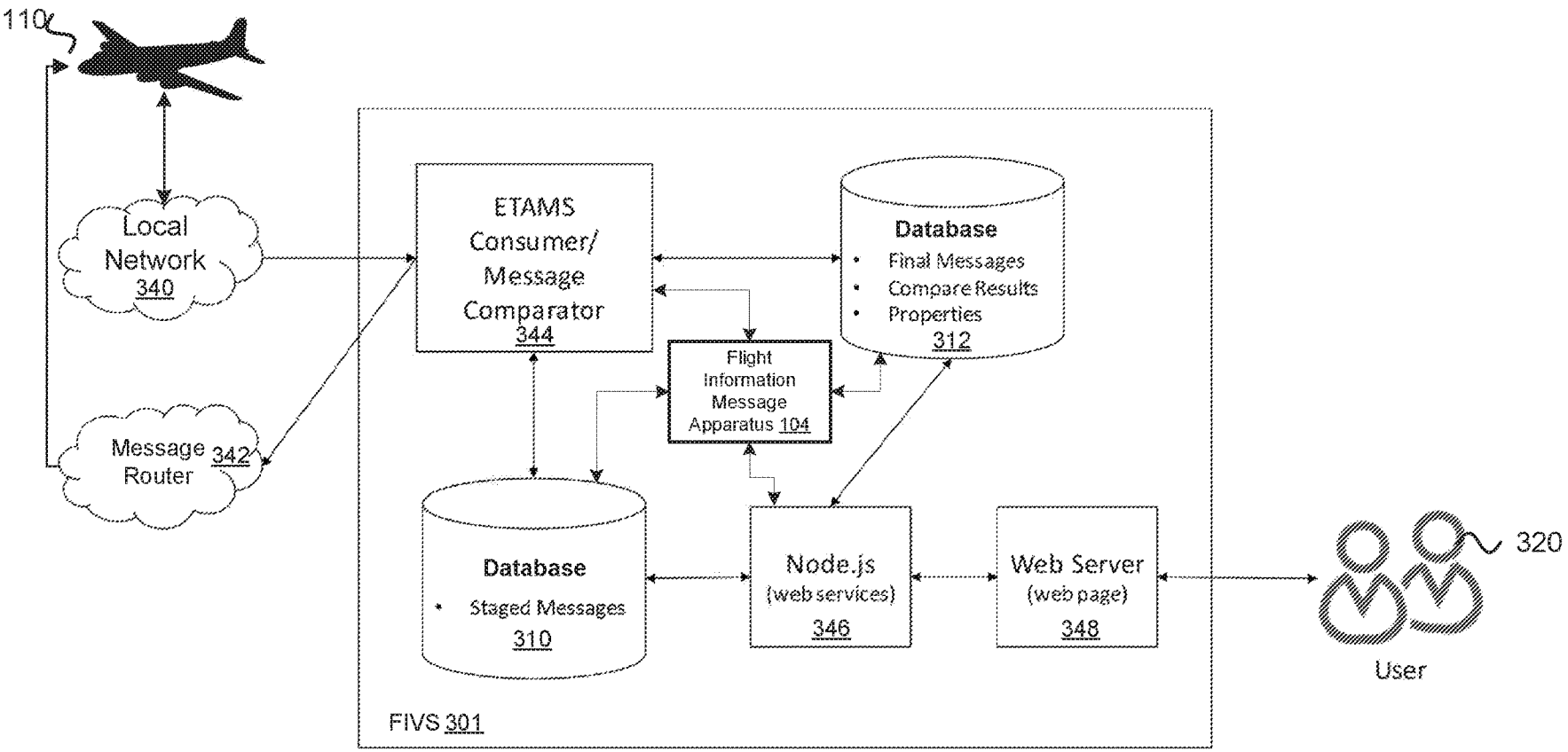
FIG. 3B illustrates another example embodiment of systems for verifying flight information, according to one or more examples of the present disclosure.

FIG. 3B depicts another embodiment of a flight information verification system ("FIVS") 301. FIG. 3B is substantially similar to the FIVS 301 described above in FIG. 3A. FIG. 3B describes a FIVS 301 that is a ground-based message computing system that is connected to an aircraft 110 over a local network 340 and a message router 342 that may be located on the local network 340. As used herein, the local network 340 is configured to handle a plurality of communications protocols (e.g., an Internet, Airline, Air Traffic Control protocols) over a plurality of communication channels (e.g. internet, radio, or satellite networks).

Similar to the FIVS 301 in FIG. 3A, a local message comparator 344 may compare flight information for messages sent to the aircraft 110 and corresponding flight information for messages received from the aircraft 110. The results of the comparison may be stored in a database 312, e.g., a relational database such as PostgreSQL®, MySQL®, and/or the like.

The notification module 208, based on the results of the comparison, provides a notification to one or more users 320 via web services 346 such as a web service build on a JavaScript engine. The notification may then be presented to the users 320 via a web page provided by a web server 348.

Figure 4:
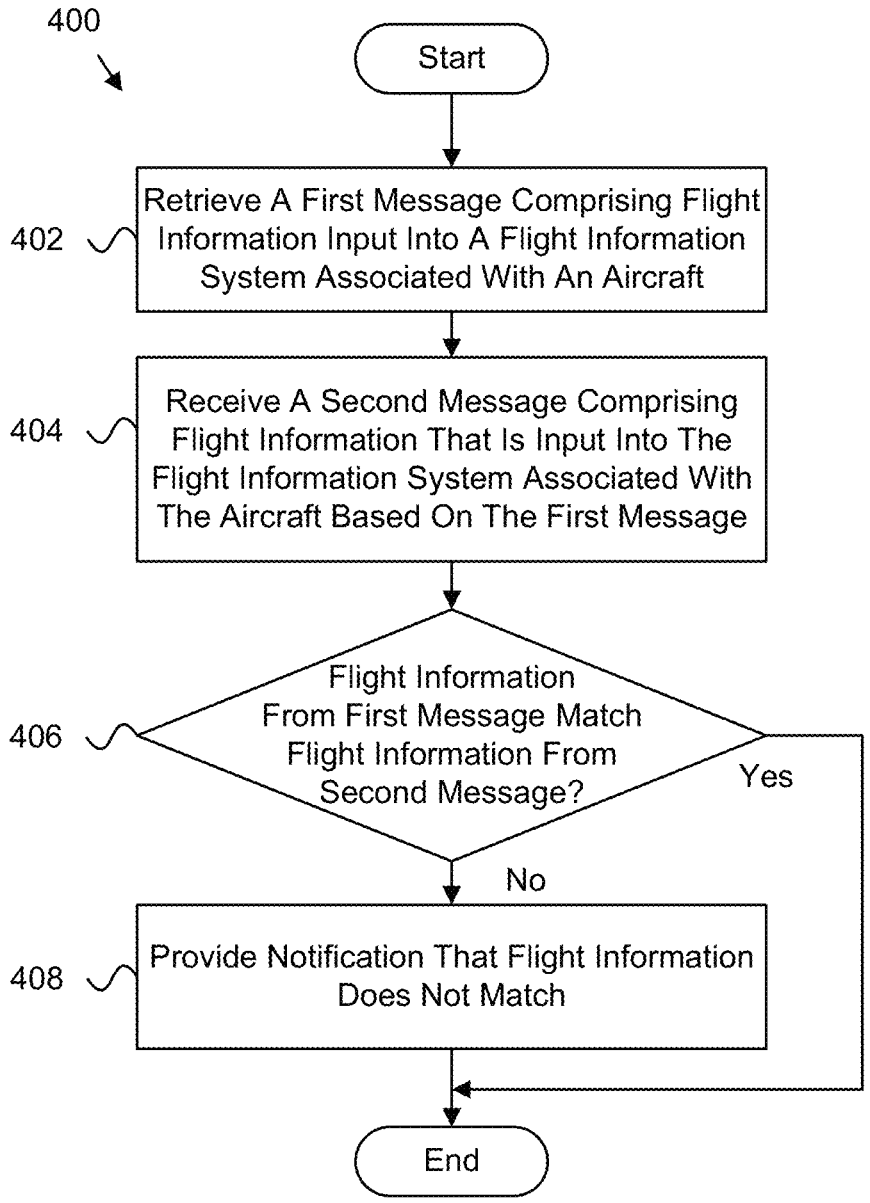
FIG. 4 is a schematic flow diagram of a method for verifying flight information, according to one or more examples of the present disclosure.

FIG. 4 is a schematic flow-chart diagram illustrating one embodiment of a method 400 for verifying flight information. The method 400 begins and retrieves 402 a first message comprising flight information that is input into a flight information system associated with a flight. The method 400 receives 404 a second message comprising flight information that is input into the flight information system associated with the flight based on the first message.

The method 400 determines 406 whether the flight information from the first message matches the flight information from the second message. If yes, then the method 400 ends. Otherwise, the method 400 provides 408 a notification in response to verifying that the flight information that is sent in the first message does not match the flight information that is received in the second message, and the method 400 ends. In some embodiments, the flight information retrieval module 202, the message receiving module 204, the verification module 206, and the notification module 208 perform the various steps of the method 400.

Figure 5:
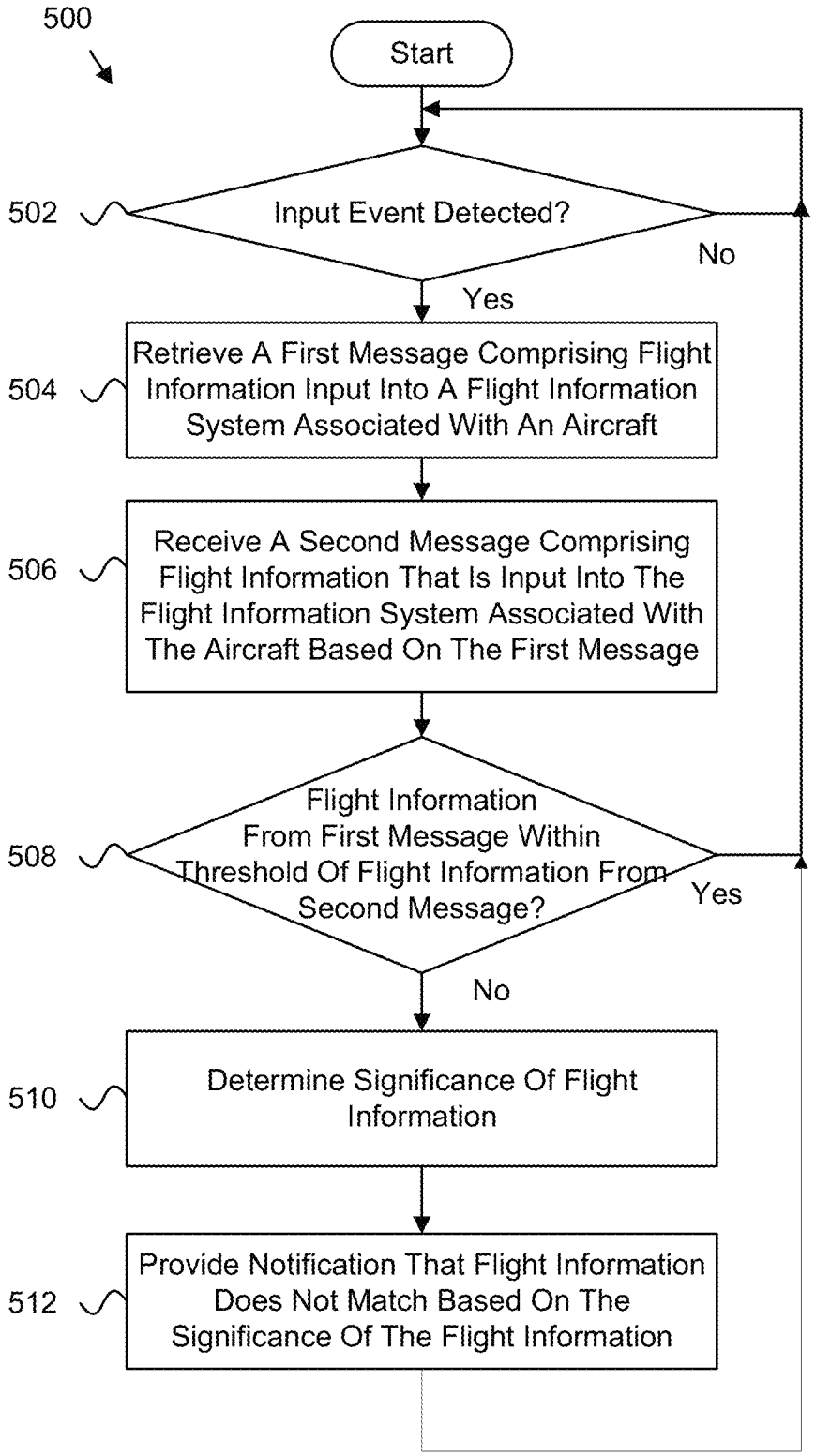
FIG. 5 is a schematic flow diagram of a method for verifying flight information, according to one or more examples of the present disclosure.

FIG. 5 is a schematic flow-chart diagram illustrating one embodiment of a method 500 for verifying flight information. The method 500 begins and determines 502 whether an input event is detected, e.g., whether flight information has been inputted or entered into a flight information system. If not, the method 500 continues to monitor 502 for input events. Otherwise, the method 500 retrieves 504 a first message comprising flight information that is input into a flight information system associated with a flight.

The method 500 receives 506 a second message comprising flight information that is input into the flight information system associated with the flight based on the first message. The method 500 determines 508 whether the flight information from the first message matches the flight information from the second message within a predetermined threshold. If so, the method 500 continues to monitor 502 for input events.

Otherwise, the method determines 510 a significance, importance, or the like of the flight information and/or the mismatch (e.g., the degree or amount of difference) between the flight information from the message sent to the flight information system associated with the flight and the message received from the flight information system associated with the flight. The method 500 provides 512 a notification in response to verifying that the flight information that is sent in the first message does not match the flight information that is received in the second message based on the significance of the flight information and/or the mismatch, and the method 500 ends. In some embodiments, the flight information retrieval module 202, the message receiving module 204, the verification module 206, the notification module 208, and the input event module 210 perform the various steps of the method 500.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two."

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

Conditional language used herein, such as, among others, "can," "could," "might," "may," "e.g.," and the like, unless specifically stated otherwise, or otherwise understood within the context as used, is generally intended to convey that certain examples include, while other examples do not include, certain features, elements, and/or steps. Thus, such conditional language is not generally intended to imply that features, elements and/or steps are in any way required for one or more examples or that one or more examples necessarily include logic for deciding, with or without input or prompting, whether these features, elements and/or steps are included or are to be performed in any particular example. Also, the term "or" is used in its inclusive sense (and not in its exclusive sense) so that when used, for example, to connect a list of elements, the term "or" means one, some, or all of the elements in the list.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Embodiments of the various modules may take the form of an entirely hardware embodiment, an entirely software embodiment (including firmware, resident software, microcode, etc.) or an embodiment combining software and hardware aspects that may all generally be referred to herein as a "circuit," "module" or "system." Furthermore, embodiments may take the form of a program product embodied in one or more computer readable storage devices storing machine readable code, computer readable code, and/or program code, referred hereafter as code. The storage devices may be tangible, non-transitory, and/or non-transmission. The storage devices may not embody signals. In a certain embodiment, the storage devices only employ signals for accessing code.

The modules may be implemented as a hardware circuit comprising custom very-large-scale integration (VLSI) circuits or gate arrays, off-the-shelf semiconductors such as logic chips, transistors, or other discrete components. The modules may also be implemented in programmable hardware devices such as field programmable gate arrays, programmable array logic, programmable logic devices or the like.

The modules may also be implemented in code and/or software for execution by various types of processors. An identified module of code may, for instance, comprise one or more physical or logical blocks of executable code which may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Indeed, a module of code may be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different computer readable storage devices. Where a module or portions of a module are implemented in software, the software portions are stored on one or more computer readable storage devices.

Any combination of one or more computer readable medium may be utilized by the modules. The computer readable medium may be a computer readable storage medium. The computer readable storage medium may be a storage device storing the code. The storage device may be, for example, but not limited to, an electronic, magnetic, optical, electromagnetic, infrared, holographic, micromechanical, or semiconductor system, apparatus, or device, or any suitable combination of the foregoing.

More specific examples (a non-exhaustive list) of the storage device would include the following: an electrical connection having one or more wires, a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Code for carrying out operations for embodiments may be written in any combination of one or more programming languages including an object oriented programming language such as Python, Ruby, Java, Smalltalk, C++, or the like, and conventional procedural programming languages, such as the "C" programming language, or the like, and/or machine languages such as assembly languages. The code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

The present subject matter may be embodied in other specific forms without departing from its spirit or essential characteristics. The described embodiments are to be considered in all respects only as illustrative and not restrictive. All changes which come within the meaning and range of equivalency of the claims are to be embraced within their scope.

What is claimed is:

1. A method, comprising:

retrieving a first message sent to a flight information system associated with a flight, the first message comprising flight information associated with at least one flight setting for an aircraft that is input into the flight information system;

querying the flight information system for flight information associated with the at least one flight setting for the aircraft subsequent to the flight information that is sent in the first message being input into the flight information system for the aircraft;

receiving a second message from the flight information system comprising the queried flight information that is input into the flight information system;

verifying that the flight information that is sent in the first message matches the flight information that is received in the second message to confirm that the flight information sent in the first message is correctly entered into the flight information system, wherein the flight information that is sent in the first message matches the flight information that is received in the second message in response to determining that a percentage of the first and second messages that match satisfies a threshold; and providing a notification in response to verifying that the flight information that is sent in the first message does not match the flight information that is received in the second message, the notification comprising times that the messages were sent and a status of the aircraft different than the flight information when the messages were sent.

2. The method according to claim 1, wherein the first message and the second message comprise different format types such that the first message and the second message are parsed to identify the flight information in each message for verification.

3. The method according to claim 2, wherein verification comprises comparing the flight information of the first message and the second message based on the formats of the first message and the second message to determine if the flight information of the first message and the second message match.

4. The method of claim 3, wherein the comparison of the flight information between the first message and the second message is performed on one or more of a per-bit basis, a per-byte basis, a per-character basis, a per-data-field basis, and a per-message basis.

5. The method according to claim 1, wherein the flight information that is sent in the first message is inputted into the flight information system in response to one of when the first message is received and when a user approves inputting the flight information.

6. The method according to claim 5, further comprising detecting an input event in response to the flight information in the first message being input into the flight information system, wherein the first message is retrieved, and the flight information is received in the second message, in response to the input event.

7. The method according to claim 1, wherein a type and delivery method of the notification that is provided is determined based on a significance of the flight information that is input into the flight information system and that does not match the flight information sent in the first message.

8. The method according to claim 1, wherein the notification is provided as one or more of a push notification for a mobile application, a text message, an email message, a website, and a web service.

9. The method according to claim 1, wherein one of the first message and the second message comprises an aircraft communications addressing and reporting system ("ACARS") message format.

10. The method according to claim 1, wherein the second message is published and broadcast to systems that subscribed to receive messages that comprise flight information that is input into the flight information system.

11. The method according to claim 1, wherein the second message is received from the flight information system in response to a query for the flight information.

12. An apparatus, comprising:

a processor; and a memory that stores code executable by the processor to:

retrieve a first message sent to a flight information system associated with a flight, the first message comprising flight information associated with at least one flight setting for an aircraft that is input into the flight information system;

query the flight information system for flight information associated with the at least one flight setting for the aircraft subsequent to the flight information that is sent in the first message being input into the flight information system for the aircraft;

receive a second message from the flight information system comprising the queried flight information that is input into the flight information system;

verify that the flight information that is sent in the first message matches the flight information that is received in the second message to confirm that the flight information sent in the first message is correctly entered into the flight information system, wherein the flight information that is sent in the first message matches the flight information that is received in the second message in response to determining that a percentage of the first and second messages that match satisfies a threshold; and provide a notification in response to verifying that the flight information that is sent in the first message does not match the flight information that is received in the second message, the notification comprising times that the messages were sent and a status of the aircraft different than the flight information when the messages were sent.

13. The apparatus according to claim 12, wherein the first message and the second message comprise different format types such that the first message and the second message are parsed to identify the flight information in each message for verification.

14. The apparatus according to claim 13, wherein the code is further executable by the processor to verify the flight information in each message by comparing the flight information of the first message and the second message based on the formats of the first message and the second message to determine if the flight information of the first message and the second message match.

15. The apparatus according to claim 14, wherein the comparison of the flight information between the first message and the second message is performed on one or more of a per-bit basis, a per-byte basis, a per-character basis, a per-data-field basis, and a per-message basis.

16. The apparatus according to claim 12, wherein the code is further executable by the processor to detect an input event in response to the flight information in the first message being input into the flight information system, wherein the first message is retrieved, and the flight information is received in the second message, in response to the input event, the flight information that is sent in the first message being input into the flight information system in response to one of when the first message is received and when a user approves inputting the flight information.

17. The apparatus according to claim 12, wherein a type and delivery method of the notification that is provided is determined based on a significance of the flight information that is input into the flight information system and that does not match the flight information sent in the first message.

18. A program product comprising a non-transitory computer readable storage medium that stores code executable by a processor, the executable code comprising code to:

retrieve a first message sent to a flight information system associated with a flight, the first message comprising flight information associated with at least one flight setting for an aircraft that is input into the flight information system;

query the flight information system for flight information associated with the at least one flight setting for the aircraft subsequent to the flight information that is sent in the first message being input into the flight information system for the aircraft;

receive a second message from the flight information system comprising the queried flight information that is input into the flight information system based on the flight information in the first message, the flight information queried from the flight information system in response to a request for the flight information;

verify that the flight information that is sent in the first message matches the flight information that is received in the second message to confirm that the flight information sent in the first message is correctly entered into the flight information system, wherein the flight information that is sent in the first message matches the flight information that is received in the second message in response to determining that a percentage of the first and second messages that match satisfies a threshold; and provide a notification in response to verifying that the flight information that is sent in the first message does not match the flight information that is received in the second message, the notification comprising times that the messages were sent and a status of the aircraft different than the flight information when the messages were sent.

19. The method of claim 1, wherein the status of the aircraft comprises an altitude and a speed of the aircraft.

20. The apparatus of claim 12, wherein the status of the aircraft comprises an altitude and a speed of the aircraft.

* * * * *